US005361431A

United States Patent [19]

Freier et al.

[11] Patent Number: 5,361,431

[45] Date of Patent: Nov. 8, 1994

[54] VACUUM BREAKER FOR FAUCETS

[75] Inventors: Donald P. Freier, Sheboygan; Andrew H. Matznick, New Holstein, both of Wis.

[73] Assignee: Kohler Co., Kohler, Wis.

[21] Appl. No.: 191,244

[22] Filed: Feb. 2, 1994

[51] Int. Cl.[5] ..... E03C 1/10

[52] U.S. Cl. ..... 4/677; 4/678; 137/218

[58] Field of Search ..... 4/671, 672, 675, 678; 137/216, 217, 218, 801, 526, 533.21, 676, 677

[56] References Cited

U.S. PATENT DOCUMENTS

| | | | |
|---|---|---|---|
| 4,696,322 | 9/1987 | Knapp et al. | 137/218 |
| 4,805,661 | 2/1989 | Knapp et al. | 137/218 |
| 4,827,538 | 5/1989 | Heimann et al. | 4/677 |
| 4,874,006 | 10/1989 | Iqbal | 137/119 |
| 4,977,920 | 12/1990 | Oberdorfer | 137/218 |
| 5,009,247 | 4/1991 | Oberdorfer | 137/218 |
| 5,090,062 | 2/1992 | Hochstrasser | 4/678 |
| 5,095,554 | 3/1992 | Gloor | 4/678 |
| 5,123,437 | 6/1992 | Egli et al. | 4/678 |
| 5,213,268 | 5/1993 | Gnauert et al. | 137/218 |

FOREIGN PATENT DOCUMENTS

| | | | |
|---|---|---|---|
| 3509648 | 9/1986 | Germany | 4/677 |
| 3509649 | 9/1986 | Germany | 4/677 |
| 3726436 | 2/1988 | Germany | 4/677 |
| 8813390 | 2/1989 | Germany | 137/217 |
| 4002852 | 8/1991 | Germany | 4/677 |

OTHER PUBLICATIONS

A Delta ad entitled "Single Handle Gourmet Spray", undated.

*Primary Examiner*—Henry J. Recla
*Assistant Examiner*—Gregory Vidovich
*Attorney, Agent, or Firm*—Quarles & Brady

[57] ABSTRACT

A faucet with a vacuum breaker for a pull-out spray head plumbing fixture is provided. The vacuum breaker is in the faucet housing and provides a guide for and surrounds an extendible and retractable hose connected to the pull-out spray head. The vacuum breaker has a flapper valve stretch fitted over a body member of the vacuum breaker. The body member also affords pivotal attachment of a spout. A tubular guide for the hose also provides a quick connect or disconnect feature.

12 Claims, 3 Drawing Sheets

54
56
49
57
55
2
50
52
12
40
38
37
39
42
10
34
59
44
48
36
32
30
45
24
25
28
13
26
14
21
11
22
15
20
23
17
16
18
19
27
51

FIG. 3
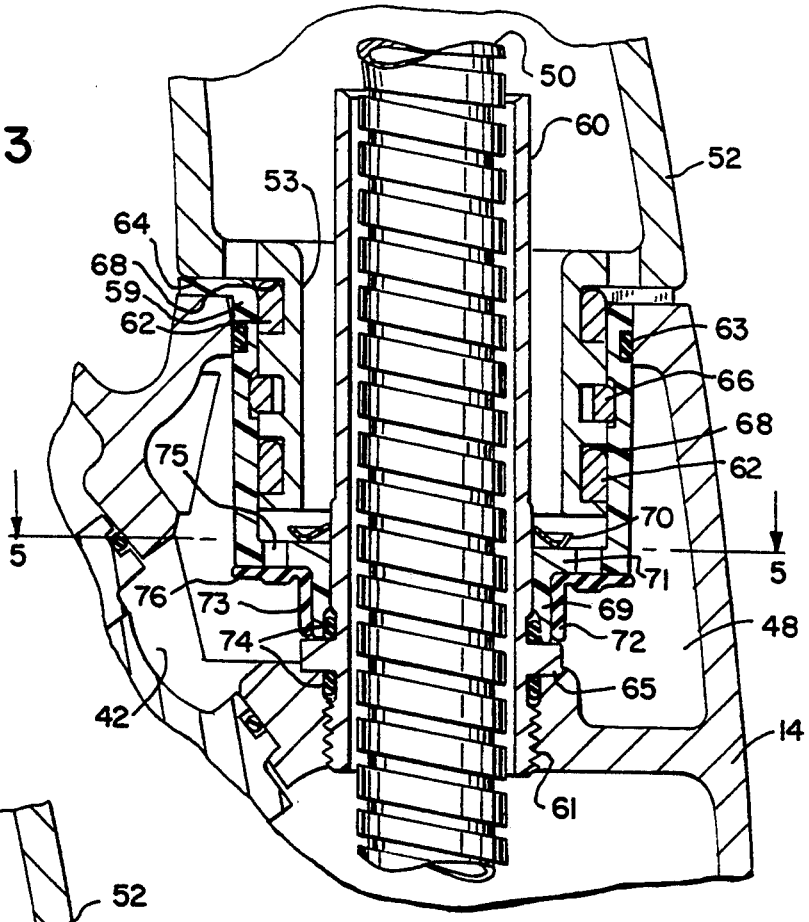
FIG. 4
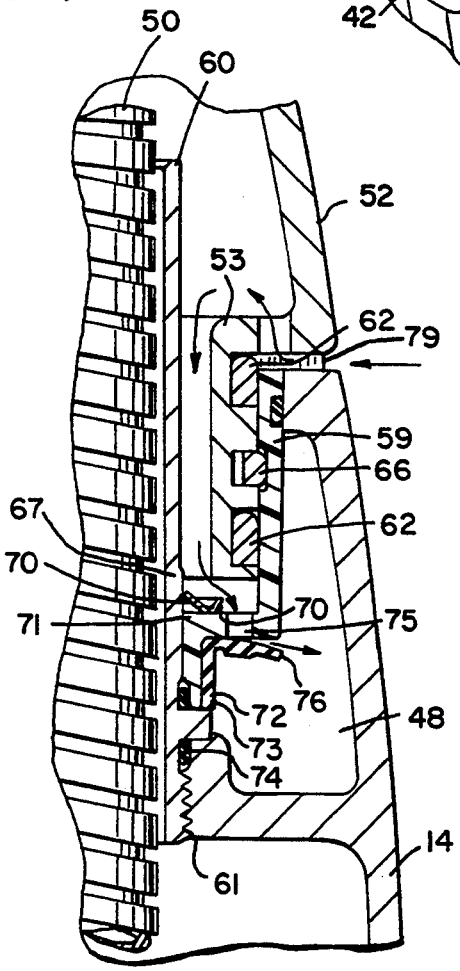
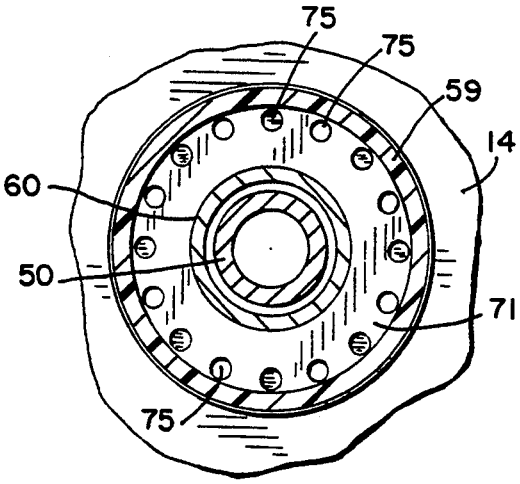
FIG. 5

VACUUM BREAKER FOR FAUCETS

BACKGROUND OF THE INVENTION

A. Field Of The Invention

This invention relates primarily to vacuum breakers for faucets. More particularly, the invention relates to vacuum breakers for use with faucets having a pull-out spray function.

B. Description Of The Art

Pull-out spray head faucets have become increasingly popular. This is particularly true with respect to kitchen and bar sink faucets. These types of faucets, however, pose special problems in that if the spray head is placed in contact with dirty water, and the supply of water is interrupted, the water supply could become contaminated by a back siphoning of the dirty water. Vacuum breakers were therefore provided in conjunction with such pull-out spray heads.

Prior art vacuum breakers for pull-out spray heads have shortcomings in that they present valving devices which require specially designed venting passages. Others are multicomponent valving devices and/or devices which are not easily installed or repaired. Neither do they afford optimal guidance for the extendible and retractable hose. Thus, it can be seen that a need exists for an improved vacuum breaker of this type.

SUMMARY OF THE INVENTION

In one aspect, the invention provides a faucet with a housing having a first bore in communication with a fluid inlet. A valve unit is positioned in the first bore for regulating fluid flow from the fluid inlet to a valve unit outlet. There is a second bore in the housing that is not co-axial to the first bore. A pull-out spray unit is mounted to a tube, the tube extending into the second bore and being axially movable therein. A conduit extends between the valve unit outlet and the tube. A vacuum breaker is positioned in the housing, with a portion of the tube passing therethrough.

Preferably the faucet includes a cylindrical guide, and the portion of the tube is located concentrically therein.

In another aspect, the vacuum breaker member includes a base section having a multiplicity of openings extending therethrough, and a flapper valve closes the openings.

In yet another aspect, the cylindrical guide includes a threaded end portion for connection with the second bore.

In another embodiment, the invention provides a vacuum breaker for use with a faucet having a pull-out spray unit. A cup shaped body member has a base portion with openings extending therethrough. A flapper valve is mounted in a closed position over the openings. A cylindrical guide is connected to the base portion for guiding a tubular member through the body member. There are connecting means operatively associated with the body member for connecting the body member to a valve housing.

The plumbing fixture of this invention affords a vacuum breaker function as well as guidance of the extendible and retractable hose.

The combined guide and vacuum breaker is easily connected or disconnected from a valve housing and is composed of few parts.

The objects of the invention therefore include:

a. providing a faucet of the above kind which can effect a vacuum breaker function in a pull-out spray apparatus as well as provide guidance of the extendible and retractable hose without requiring additional vent holes through the housing;

b. providing a faucet of the above kind which can easily and efficiently be installed and operated;

c. providing a faucet of the above kind which can be manufactured with a few parts and thus at reduced costs;

d. providing a faucet of the above kind which can be easily repaired;

e. providing a faucet of the above kind which permits a compact and an esthetic design; and f. providing a faucet of the above kind where the hose is guided through a section of the spout so as to reduce scraping of the hose on the interior sides of the housing.

These and still other objects and advantages of the invention will be apparent from the description which follows. In the detailed description below, a preferred embodiment of the invention will be described in reference to the accompanying drawings. The embodiment does not represent the full scope of the invention. Rather the invention may be employed in other embodiments.

BRIEF DESCRIPTION OF THE DRAWINGS

FIG. 3 is an enlarged detailed view of the vacuum breaker shown in a closed position;

FIG. 4 is a view generally similar to FIG. 3 showing the vacuum breaker in an open position;

FIG. 5 is a sectional view taken along line 5—5 of FIG. 3; and

DESCRIPTION OF THE PREFERRED EMBODIMENT

Figures 1, 2:
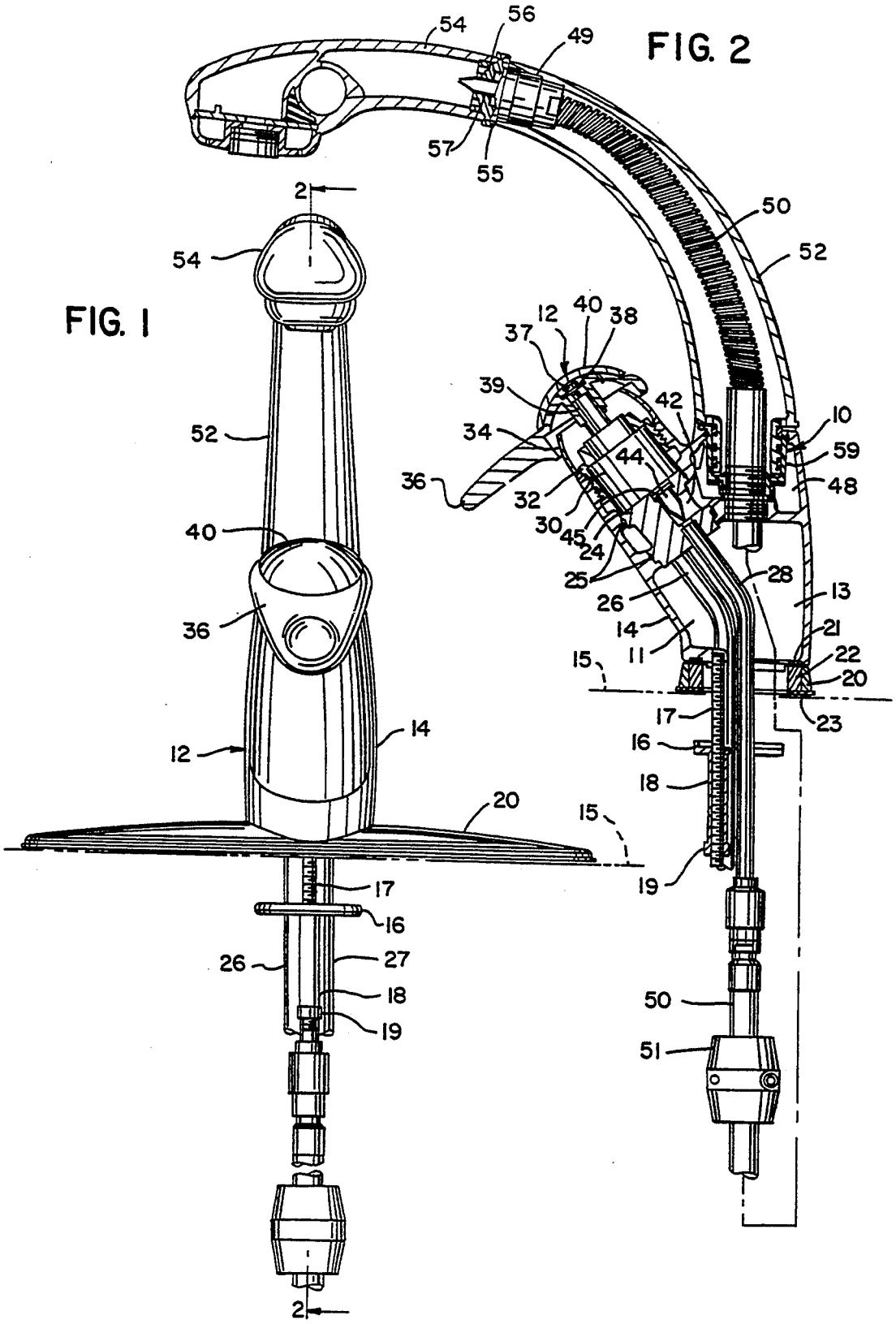
FIG. 1 is a front elevational view showing a faucet employing the vacuum breaker of this invention.
FIG. 2 is a sectional view taken along line 2—2 of FIG. 1.
Figure 6:
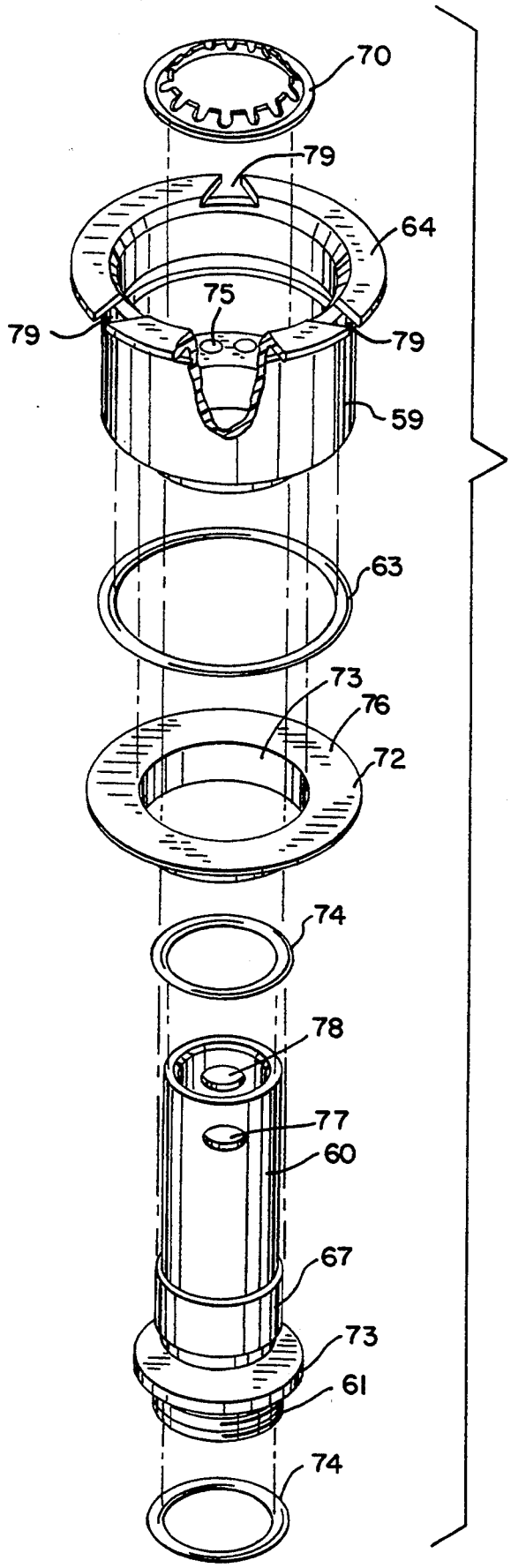
FIG. 6 is an exploded perspective view of the vacuum breaker parts shown in FIGS. 3 and 4.

Referring to FIGS. 1 and 2, the vacuum breaker, generally 10, is shown in conjunction with a faucet, generally 12, having a valve body 14 with a first axial bore 11 and a second axial bore 13 which is not co-axial with the first. Valve body 14 is secured to an escutcheon 20 and the counter top 15 by the C-clamp 16 which is pressed against the bottom of the counter by the sleeve 18. A nut 19 threaded on the post 17 forces the sleeve 18 against C-clamp 16. A spacer 22 is provided in the escutcheon 20 in addition to the gaskets 21 and 23 for mounting the valve body 14 on the counter 15.

Hot and cold water pipes 26 and 27 deliver hot and cold water to the valve insert 24 which is sealed in the valve body 14 by the O-rings 25. Valve insert 24 has suitable passages for delivering the hot and cold water to the valve 30. A mounting nut 32 secures the valve 30 in the valve body 14, and a bonnet 34 covers the nut 32 and is connected thereto. Valve 30 is of the ceramic disk cartridge type having a stationary disk with hot and cold water passages extending therethrough and a movable disk operable by the valve stem 39 for regulating the flow of water to outlet passage 42 in the insert 24. A valve regulating handle 36 is connected to the valve stem 39 by the screw 37, a washer 38, and a decorative dome 40 is placed thereover.

A check valve 44 is placed in the outlet passage 42 which is retained therein by the retainer 45. Outlet passage 42 delivers mixed hot and cold water to outlet line 28 which in turn is connected to the flexible hose 50. Hose 50 extends back through valve body 14 and into spout 52 where it is attached to spray head 54 by the nut 49 threadably engaging housing 56. A check valve 57 is located in a housing 56. A spray head 54 is seated on the end of spout 52 when it is not extended and is guided therein by insert 55. The weight 51 on hose 50 assists in a retractable seating.

Disposed in a compartment 48 of the valve body 14 is the vacuum breaker 10, the details of which are seen in FIGS. 3–6. Vacuum breaker 10 has a cylindrical body 59 for pivotally receiving an extending portion 53 of spout 52. Stabilizing rings 62 are disposed in annular grooves 68 in the extending portion 53 for contact with the inside of body 59. A split ring 66 connects the extending portion 53 to the cylindrical body 59. An annular lip 64 is placed between the spout 52 and the upper ends of body 59 to serve as a bearing support for spout 52. An O-ring 63 provides a seal between vacuum breaker body 59 and valve body 14.

A guide tube 60 is concentrically located in vacuum breaker body 59 and is attached to the valve body 14 by the threads 61. Vacuum breaker body 59 is retained on the tube 60 by the retaining ring 70 engaging an increased diameter section 67. This holds the base section 71 and a reduced diameter portion 69 against the shoulder 65 extending from tube 60. O-rings 74 are placed between the guide tube 60 and the valve body 14, as well as base section 71 to effect a proper seal.

A diaphragm 72, composed of an elastic material, is stretch fitted onto the reduced diameter portion 69 of body 59 and retained thereon by the collar portion 73. An annular portion 76 extends from the collar portion 73 for purposes of covering apertures 75 in the base section 71 of body 59.

Under normal operating conditions, the annular portion 76 covers the apertures 75 so that pressurized water in compartment 48 cannot flow through the apertures 75. This would be the normal operating condition of the faucet 12 when pressurized water is flowing therethrough. It should be noted that even when there is not a pressurized condition in compartment 48, the annular portion 76 covers the apertures 75. This is illustrated in FIG. 3.

In the event of a loss of pressure in the water supply lines 26 and 27, and the spray head 54 were left in the gray or dirty water of a sink, the gray water could be drawn into the water supply by means of the hose 50 and outlet line 28. A reduction in pressure in the insert 24, passage 42 and compartment 48 causes the annular portion 76 to be drawn downwardly and away from the apertures 75 thus drawing air from the atmosphere in from the spout 52 to break the vacuum. Air is easily drawn into the spout 52 when the spray head 54 is not seated on the end thereof, as well as through slots 79 in lip 64 of body 59. Diaphragm 72 thus functions as a one-piece flapper valve.

An important feature of the vacuum breaker 10 is the positioning in a compartment for the spout 52. This obviates having to design a separate channel or passageway for venting purposes as it is effected through the spout 52. Another important feature is the guide tube 60. This not only serves as a guide for hose 50 as it is extended and retracted from spout 52 but also provides a quick assembly or disassembly of the vacuum breaker 10 in view of the threaded connection 61. Openings are provided at 77 and 78 for tool insertion.

It will therefore be appreciated that a vacuum breaker 10 is provided which simplifies the design of the valve body in eliminating air passages therethrough. By placing the vacuum breaker 10 adjacent and below the valve 30, a compact design is realized. Further, ease of assembly is afforded by a guide tube for the pullout hose, the guide tube being easily connected or disconnected.

Still another feature of the vacuum breaker 10 is the simplified construction. It requires only a one-piece diaphragm 72 stretched over the body 59 of the vacuum breaker 10.

Thus, the invention provides an improved valve assembly. While a preferred embodiment has been described above, it should be readily apparent to those skilled in the art that a number of modifications and changes may be made without departing from the spirit and scope of the invention. For example, while a particular plumbing valve has been shown, other valves can be used with the vacuum breaker. Also, the specific materials mentioned are not the only materials which can be used. All such and other modifications within the spirit of the invention are meant to be in the scope of the invention.

We claim:

1. A faucet comprising:

a faucet housing having a first bore communicating with a fluid inlet;

a valve unit positioned in the first bore for regulating a flow of fluid from the fluid inlet to an outlet of the valve unit;

a second bore in the housing that is not co-axial to the first bore;

a pull-out spray unit mounted to a tube, the tube extending into the second bore and being axially movable therein;

a conduit operatively connected between the valve unit outlet and the tube; and a vacuum breaker positioned in the housing, the vacuum breaker including a guide member positioned therein with a portion of the tube passing therethrough.

2. The faucet of claim 1, wherein the portion of the tube is located concentrically within the guide member.

3. The faucet of claim 2, wherein the vacuum breaker includes a base section, having a multiplicity of openings extending therethrough and a flapper valve mountable in a closed position over the openings.

4. The faucet of claim 3, wherein the guide member includes a threaded portion for connection with the second bore.

5. The faucet of claim 3, wherein the base section is coupled to the guide member by an internal retaining ring member.

6. The faucet of claim 3, wherein the guide member is located in the second bore.

7. The faucet of claim 1, wherein the first and second bores have longitudinal axes which are at an angle of less than ninety degrees with respect to one another.

8. A vacuum breaker for use with a faucet having a pull-out spray unit comprising:

a cup shaped body member having a base portion with openings extending therethrough;

a flapper valve mounted in a closed position over the openings;

a cylindrical guide connected to the base portion for guiding a tubular conduit member adapted to be connected to said unit through the body member; and connecting means operatively associated with the body member for connecting the body member to a valve housing.

9. The vacuum breaker of claim 8, wherein the connecting means are screw threads disposed on the cylindrical guide.

10. The vacuum breaker of claim 8, wherein the flapper valve is of a one-piece construction, the flapper valve composed of an elastic material and being stretch fitted onto the body member.

11. The vacuum breaker of claim 8, wherein the body member has an annular lip portion extending outwardly from the body member to provide a bearing surface for a faucet spout.

12. The vacuum breaker of claim 8, wherein the cylindrical guide is positioned concentrically with respect to the body member.

* * * * *